United States Patent [19]

Cedarleaf

[11] 4,028,116

[45] June 7, 1977

[54] SOLUTION FOR ELECTROLESS CHROME ALLOY PLATING

[76] Inventor: Curtis E. Cedarleaf, 4826 Spring Creek Road, Rockford, Ill. 61111

[22] Filed: Dec. 1, 1972

[21] Appl. No.: 311,437

[52] U.S. Cl. ..... 106/1; 427/437; 427/438

[51] Int. Cl.[2] ..... C23C 3/02

[58] Field of Search ..... 106/1; 117/130 E; 427/437, 438

[56] References Cited

UNITED STATES PATENTS

| | | | |
|---|---|---|---|
| 2,762,723 | 9/1956 | Talmey et al. | 117/130 E |
| 3,148,072 | 9/1964 | West et al. | 106/1 |
| 3,178,311 | 4/1965 | Cann | 106/1 |
| 3,226,924 | 1/1966 | Dalpiaz | 106/1 |
| 3,627,545 | 12/1971 | Mallory et al. | 106/1 |
| 3,672,940 | 6/1972 | Funada et al. | 106/1 |

*Primary Examiner*—Lorenzo B. Hayes
*Attorney, Agent, or Firm*—Morsbach & Pillote

[57] ABSTRACT

There is herein disclosed an aqueous plating bath for electroless or catalytic deposition of chromium upon the surface of a substrate capable of accepting such deposition or which has been treated to provide a surface capable of accepting such deposition. The solution is characterized by the presence of chromium as an organic chromium compound such as chromium acetate or the equivalent in relatively high concentration, the presence of nickel as a nickel compound, such as nickel acetate or its equivalent in relatively low concentration only sufficient to render the deposit catalytic, together with the usual reducing and buffering compounds to which may be added a complexing reagent comprising the salts of oxalic acid all of which cooperate to produce a deposit substantially higher in chromium content than has heretofore been possible.

5 Claims, No Drawings

SOLUTION FOR ELECTROLESS CHROME ALLOY PLATING

DESCRIPTION

The so-called electroless plating process is now well known in the art as embodying a process for the deposition of a metallic coating, usually nickel, on a substrate which may be metal or other composition commonly by submerging in an aqueous solution. The process is believed to be catalytic in nature but it appears that the process is not well understood. Certain substrates requiring pre-treatment of the surface to facilitate the action is well known in the art. The art has developed primarily in connection with deposition of nickel but some effort has been directed to the deposition of chromium. However, it appears that none of these attempts to deposit chromium have been sufficiently successful to warrant commercial applications primarily due to the fact that they have not resulted in the deposit of chromium in significant amounts or the deposit a sufficiently continuous chromium surface.

An important object of this invention is the provision of an improved plating solution capable of producing a deposit having substantially higher percentages of chromium than has heretofore been possible thereby producing a resultant product of improved characteristics permitting the use of the product in fields heretofore not available.

Another object of the invention is the provision of a plating solution which produces a deposit having suitable hardness without cold working though it can be increased by heat treatment or cold working or both.

In carrying out a deposition process utilizing the plating solution of this invention, the substrate to which the deposition is to be applied is submerged in the solution in the known manner in accordance with the teaching of the art. Where the substrate is a substrate capable of accepting the deposition without treatment, it need only be cleaned and prepared by common surface cleaning practices in electroless plating. Likewise, where the surface needs pre-treatment this should be performed in the manner known to the art.

The plating solution of this invention comprises a relatively high concentration of chromium ions derived from a suitable organic compound of chromium, the preferred compound being chromium acetate, though other organic compounds may be employed, such as the citrate, glycolate and others such as known to afford chromium ions in such plating solutions. The concentration should be in the range between about 10 and 40 grams per liter, the preferred concentration being in the region of 25 grams per liter.

Nickel ions are also present in the solution in substantially lower concentration than the chromium, the primary function of the nickel being to render the deposit catalytic, the nickel being added as a nickel salt, preferably an organic salt, the preferred one being nickel acetate, though other equivalents can be used such as the citrate, glycolate, succinate, sulfate, chloride and others known to the art as effective in such plating solutions. The compound should be present at least to the extent of about two grams per liter to cause the process to continue to a sufficient degree but preferably should not be more than about 5 grams per liter beyond which the deposit of nickel exceeds that which is desired to maximize the chromium deposit.

The solution employs a reducing agent such as heretofore commonly used in electroless plating solutions, the most effective and commonly employed being the hypophosphites such as sodium or potassium hypophosphite which should be present in the range of 5 grams to 40 grams per liter preferably in the region of 25 grams per liter.

It is also necessary to use a suitable buffering agent or agents to maintain the pH of the solution in the desired range. These, as known in the art may consist of the salts of acetic acid, citric acid, glycolic acid, succinic acid and others known to the art, the selection being determined by the pH desired and convenience in controlling the bath.

In general the individual buffering agents should not exceed about 80 grams per liter. In the examples herein disclosed the preferred range for the acetates is 10 to 35 grams per liter, the range for the hydroxyacetates and the citrates is 15 to 50 grams per liter and when these two groups are used in combination the total should not exceed about 125 grams per liter.

It has been discovered that the life of the bath can be extended and the solution stabilized by the addition of lead nitrate in amounts between about 1.0 and 4.0 P.P.M. and that it adds brightness to the resultant deposit. Furthermore, the addition of a copper salt preferably cupric acetate or other equivalent copper salt in this solution in amounts up to about 0.1 grams per liter results in the deposit of minimum quantities of copper in the plate and enhances the ductility of the plate.

The solution should be used at a pH in the range of 3.5 to 6.0 and at temperatures between about 200 and 212 degrees Farenheit.

EXAMPLE 1

A bath was prepared having the following composition:

| | |
|---|---|
| Chromic Acetate | 25 grams per liter |
| Nickel Acetate | 4 grams per liter |
| Sodium Acetate | 25 grams per liter |
| Sodium Hydroxyacetate | 40 grams per liter |
| Sodium Hypophosphite | 25 grams per liter |
| Potassium Oxalate | 5 grams per liter |
| Cupric Acetate | 0.1 grams per liter |
| Lead Nitrate | 3.0 parts per million |
| Temperature | 208° F. |

s

The resultant bath had a pH of about 4.5 and was used for producing a deposit on a stainless steel mold for molding rubber. Spectrographic analysis of the deposit showed that it contained 15 to 30% of chromium, 10 to 15% of phosphide together with traces of copper and lead, the balance being essentially nickel.

By way of comparison tests were conducted on the molds with the following results: Corrosive atmosphere tests of similar molds when plated with electroless nickel showed immediate staining and failure in about two weeks, when plates with hard chromium electroplating showed no stain but erosion required replating after five months and when plated with the above-identified solution the mold staining was present after about one month and no failure appeared in five months.

Low carbon steel showed the following comparative results in surface hardness conducted with the Tukon Microhardness Tester when expressed in equivalent Rockwell "C" hardness scale: Electroless nickel plate, as plated 49 and as heat treated up to 68; hard chromium electroplate as plated up to 70; electroless chrome alloy prepared with the above-identified solution, 63 as plated and up to 80, as heat treated.

Comparative wear tests conducted on a switching device of low carbon steel showed failure in less than one million cycles when plated with electroless nickel alloy, failure is about 20 million cycles when plated with hard chrome electroplating and failure in the region between 14 and 16 million when plated with electroless chrome alloy in the above-identified solution.

EXAMPLE 2

A solution of the same formulation as in Example 1 but omitting the copper salt gave virtually the same results as in Example 1 except that the deposit exhibited considerably less ductility in the deposit.

EXAMPLE 3

A solution of the same formulation as in Example 1 but omitting the lead content resulted in about a 20% increase in the rate of deposit and a much shorter life span in the bath. The deposit was considerably less bright than the plate resulting from Example 1.

EXAMPLE 4

A bath of the following composition was prepared and used with a substrate of low carbon steel:

| | |
|---|---|
| Chromium Acetate | 10 grams per liter |
| Nickel Acetate | 2 grams per liter |
| Sodium | 25 grams per liter |
| Sodium Hydroxyacetate | 40 grams per liter |
| Sodium Hypophosphite | 25 grams per liter |
| Potassium Oxalate | 1.0 grams per liter |
| Cupric Acetate | 0.1 grams per liter |
| Lead Nitrate | .001 parts per million |
| pH | 4.5 |
| Temperature | 208° F. |

The plating rate was about 0.0004 inches per hour during the first half hour and then dropped to about 0.0001 inches per hour for the next hour, after which plating stopped. The plate deposited during the first half hour was bright and the ductility was good. Thereafter the deposit became dull in appearance, the ductility was substantially reduced and the deposit became spotty.

EXAMPLE 5

A solution of the same composition as that of Example 4 was prepared and used with a substrate of low carbon steel but in which the concentration of oxalate was increased to 5.0 grams per liter. This solution resulted in a much lower plating rate and the deposit dull and rough.

EXAMPLE 6

A solution was prepared having the following composition and used to plate a substrate of low carbon steel:

| | |
|---|---|
| Chromium Acetate | 40 grams per liter |
| Nickel Acetate | 6 grams per liter |
| Sodium Acetate | 25 grams per liter |
| Sodium Hydroxyacetate | 40 grams per liter |
| Sodium Hypophosphite | 25 grams per liter |
| Potassium Oxalate | 1.0 grams per liter |
| Cupric Acetate | .01 grams per liter |
| Lead Nitrate | .001 parts per million |
| pH | 4.5 |
| Temperature | 208° F. |

This solution plated very rapidly during the first half hour at a rate of about 0.0008 inches per hour after which the rate dropped to about 0.0005 inches per hour. The deposit was very bright and the ductility of the deposit was good. Increase of the oxalate to 5 grams per liter gave virtually the same results.

EXAMPLE 7

A bath of the same composition as set forth in Example 1 was prepared except that the pH was adjusted to about 3.3 with sulfuric acid. The plating rate on a low carbon steel substrate was very low—about 0.0001 inches per hour. The deposit was very bright, the ductility of the plate was good and the deposit appeared to be very dense.

EXAMPLE 8

A bath of the same composition as in Example 1 was prepared except that the pH was adjusted to about 6.5 with ammonium hydroxide. This resulted in a plating rate of about 0.0006 inches per hour. The deposit was very bright but the bath tended to be unstable with a relatively short estimated life.

I claim:

1. An aqueous solution for electroless or catalytic deposition of chromium alloy consisting essentially of an organic chromium salt having a concentration between about 10 to 40 grams per liter, a nickel salt having a concentration of not less than about 2 grams per liter and not more than about one-fifth the concentration of the chromium salt; a hypophosphite reducing agent having a concentration of between 5 and 30 grams per liter; a buffering compound capable of maintaining the pH of the solution between 3.5 and 6; and a complexing agent comprising a water soluble salt of oxalic acid in concentration about 1 to 5 grams per liter.

2. A solution as set forth in claim 1 containing a copper salt in an amount no greater than about 0.1 grams per liter to lend ductility to the deposit.

3. An aqueous solution for electroless deposition of chromium consisting essentially of an organic chromium salt having a concentration of about 25 grams per liter, a nickel salt having a concentration of about 4 grams per liter, a hypophosphite reducing agent having a concentration of about 25 grams per liter, a buffering compound capable of maintaining the pH of the solution at about 4.5, and a complexing agent comprising a water soluble salt of oxalic acid in concentration of about 5 grams per liter.

4. A solution as set forth in claim 1 wherein the chromium salt is chromium acetate, the nickel salt is nickel acetate, the reducing agent is a hypophosphite taken from the group comprising sodium and potassium hypophosphite, the buffering agent is an acetate selected from the group comprising sodium or potassium acetate, sodium or potassium hydroxyacetate and sodium or potassium amino acetate and the complexing agent comprises an oxalate selected from the group comprising sodium and potassium oxalate.

5. A solution as set forth in claim 3 wherein the chromium salt is chromium acetate, the nickel salt is nickel acetate, the hypophosphite is sodium hypophosphite, the buffering compound is sodium acetate and the complexing agent is sodium oxalate.

* * * * *

UNITED STATES PATENT AND TRADEMARK OFFICE

CERTIFICATE OF CORRECTION

PATENT NO. : 4,028,116

DATED : June 7, 1977

INVENTOR(S) : Curtis E. Cedarleaf

It is certified that error appears in the above-identified patent and that said Letters Patent are hereby corrected as shown below:

Column 4, line 43, add -- alloy -- following "chromium".

Signed and Sealed this

*Sixth* Day of *September 1977*

[SEAL]

*Attest:*

RUTH C. MASON
*Attesting Officer*

LUTRELLE F. PARKER
*Acting Commissioner of Patents and Trademarks*